US011341881B2

(12) United States Patent
Lin et al.

(10) Patent No.: US 11,341,881 B2
(45) Date of Patent: May 24, 2022

(54) LEVEL SHIFTER CIRCUIT APPLIED TO DISPLAY APPARATUS

(71) Applicant: Raydium Semiconductor Corporation, Hsinchu (TW)

(72) Inventors: Po-Cheng Lin, Hsinchu (TW); Yu-Chun Lin, Jinhu Township (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 526 days.

(21) Appl. No.: 15/013,435

(22) Filed: Feb. 2, 2016

(65) Prior Publication Data

US 2016/0240162 A1 Aug. 18, 2016

Related U.S. Application Data

(60) Provisional application No. 62/115,342, filed on Feb. 12, 2015.

(51) Int. Cl.
*G09G 3/36* (2006.01)
*G09G 3/20* (2006.01)

(52) U.S. Cl.
CPC ..... *G09G 3/20* (2013.01); *G09G 2300/0871* (2013.01); *G09G 2310/0289* (2013.01)

(58) Field of Classification Search
CPC ... G09G 2310/0289; G09G 2300/0871; H03K 19/018521; H03K 3/012; H03K 3/356113
See application file for complete search history.

(56) References Cited

U.S. PATENT DOCUMENTS 4,714,840 A * 12/1987 Proebsting ..... H03K 19/018507 326/103
5,444,396 A * 8/1995 Soneda ..... H03K 3/356113 326/27
5,539,334 A * 7/1996 Clapp, III ..... H03K 3/356017 326/30
5,670,869 A * 9/1997 Weisenbach ..... G05F 3/242 323/313
6,556,061 B1 * 4/2003 Chen ..... H03K 17/102 327/333

(Continued)

OTHER PUBLICATIONS

Kiran Agarwal Gupta, V Venkateswarlu, Dinesh Anvekar, "The Impact of Channel-Width on Threshold Voltage for Short Channel Devices", Nov. 21-24, 2011, TENCON 2011-2011 IEEE Region 10 Conference.*

*Primary Examiner* — Dong Hui Liang

(57) ABSTRACT

A level shifter circuit includes an input terminal, a first output terminal, a second output terminal, an output stage, a first control bias unit, a second control bias unit, and an output stage. The input stage includes a first transistor and a second transistor, and their gates are coupled to the input terminal. The first control bias unit includes a third transistor and a fourth transistor coupled to the first transistor and second transistor respectively and their gates are controlled by a first bias. The output stage includes a fifth transistor and a sixth transistor coupled to the third transistor and fourth transistor respectively and their gates are coupled to the first output terminal and second output terminal. The second control bias unit includes a seventh transistor and an eighth transistor coupled to the fifth transistor and sixth transistor respectively and their gates are controlled by a second bias.

5 Claims, 3 Drawing Sheets

(56) References Cited

U.S. PATENT DOCUMENTS

| | | | | |
|---|---|---|---|---|
| 6,700,429 | B2 * | 3/2004 | Kanno | H03K 3/356113 327/333 |
| 7,053,657 | B1 * | 5/2006 | Peng | H03K 3/356113 326/80 |
| 7,183,817 | B2 * | 2/2007 | Sanchez | H03K 19/018585 327/112 |
| 7,468,615 | B1 * | 12/2008 | Tan | H03K 19/00315 326/68 |
| 7,768,308 | B2 * | 8/2010 | Maede | H03K 3/356113 326/68 |
| 9,859,894 | B1 * | 1/2018 | Chou | H03K 3/356182 |
| 2003/0193362 | A1 * | 10/2003 | Kobayashi | H03K 17/102 327/333 |
| 2007/0034961 | A1 * | 2/2007 | Kimura | G09G 3/20 257/365 |
| 2011/0298519 | A1 * | 12/2011 | Liu | H03K 3/356113 327/333 |
| 2012/0098584 | A1 * | 4/2012 | Huang | H03K 3/356191 327/333 |
| 2014/0015587 | A1 * | 1/2014 | Chen | H03K 3/356182 327/333 |

* cited by examiner

Time
Time
Time
T
SIN
SOUT
ITR

LEVEL SHIFTER CIRCUIT APPLIED TO DISPLAY APPARATUS

BACKGROUND OF THE INVENTION

1. Field of the Invention

This invention relates to a level shifter, especially to a level shifter circuit applied in a driving IC of a display.

2. Description of the Related Art

In general, the level shifter circuit can be one of the most important circuits in the driving IC of the LCD apparatus. No matter the source driving IC or gate driving IC, each driving IC needs the level shifter circuit to adjust the voltage level of the input signal and convert it into an output signal having high voltage, so that the operation requirements of the LCD apparatus can be satisfied. Therefore, as to the performance and the cost of the driving IC of the LCD apparatus, the level shifter circuit actually plays a very important role.

Please refer to FIG. 1. FIG. 1 illustrates a schematic diagram of a common level shifter circuit in the prior art. As shown in FIG. 1, the first transistor M1 and the second transistor M2 coupled to the input terminal IN of the level shifter circuit 1 are both high-voltage transistors having high threshold voltage; therefore, the larger W/L ratio is necessary to them and when the voltage level of the input signal $S_{IN}$ is changed, larger transient current will be generated accordingly.

At the poorest condition, when the gates of the first transistor M1 and the second transistor M2 having high threshold voltage receive the input signal $S_{IN}$ and its reverse-phase signal having very low voltage level, the first transistor M1 and the second transistor M2 will fail to be switched on; therefore, the level shifter circuit 1 cannot be operated normally.

SUMMARY OF THE INVENTION

Therefore, the invention provides a level shifter circuit applied in a driving IC of a display to solve the above-mentioned problems.

A preferred embodiment of the invention is a level shifter circuit applied. In this embodiment, the level shifter circuit is applied in a driving circuit of a display to convert an input signal having a first voltage into an output signal having a second voltage. The level shifter circuit includes an input terminal, a first output terminal, a second output terminal, an input stage, a first control bias unit, an output stage and a second control bias unit.

The input terminal is configured to receive the input signal. The first output terminal and a second output terminal are configured to output the output signal respectively. The input stage includes a first transistor and a second transistor, wherein gates of the first transistor and the second transistor are coupled to the input terminal. The first control bias unit includes a third transistor and a fourth transistor coupled to the first transistor and the second transistor respectively, wherein gates of the third transistor and the fourth transistor are controlled by a first bias.

The output stage includes a fifth transistor and a sixth transistor coupled to the third transistor and the fourth transistor respectively, wherein gates of the fifth transistor and the sixth transistor are coupled to the first output terminal and the second output terminal respectively. The second control bias unit includes a seventh transistor and an eighth transistor coupled to the fifth transistor and the sixth transistor respectively, wherein gates of the seventh transistor and the eighth transistor are controlled by a second bias. The first transistor, the second transistor, the third transistor and the fourth transistor are N-type transistors and the fifth transistor, the sixth transistor, the seventh transistor and the eighth transistor are P-type transistors.

In an embodiment, the gates of the first transistor and the second transistor receive the input signal and a reverse-phase signal of the input signal respectively and switched on accordingly.

In an embodiment, the second voltage is larger than the first voltage.

In an embodiment, threshold voltages of the first transistor and the second transistor of the input stage are smaller than threshold voltages of the third transistor, the fourth transistor, the fifth transistor, the sixth transistor, the seventh transistor and the eighth transistor.

In an embodiment, W/L ratios of the first transistor and the second transistor of the input stage are smaller than W/L ratios of the third transistor, the fourth transistor, the fifth transistor, the sixth transistor, the seventh transistor and the eighth transistor.

In an embodiment, the first transistor, the third transistor, the fifth transistor and the seventh transistor are coupled in series between an operating voltage and a ground voltage.

In an embodiment, the second transistor, the fourth transistor, the sixth transistor and the eighth transistor are coupled in series between an operating voltage and a ground voltage.

In an embodiment, the driving circuit of the display is a source driver circuit or a gate driver circuit.

In an embodiment, the driving circuit of the display is a source driver circuit or a gate driver circuit.

In an embodiment, the plurality of high-voltage elements comprises an output buffer or a digital-to-analog converter (DAC).

Compared to the prior art, the level shifter circuit of the invention is applied in a source driving IC or a gate driving IC of a display; the level shifter circuit of the invention includes two bias controlling units and control power consumption through a second control bias. Since the first transistor and the second transistor in the input stage of the level shifter circuit of the invention are both low-voltage transistors having low threshold voltages, the W/L ratios of them can be small. Since the transistors have small W/L ratios in the input stage of the level shifter circuit and a proper second control bias is provided, the transient current can be reduced when the voltage level of the input signal is changed. Even the input signal inputted to the level shifter circuit of the invention has very low voltage, the first transistor and the second transistor having low threshold voltages in the input stage can be still switched on; therefore, the level shifter circuit of the invention can be normally operated.

In addition, since the W/L ratios of the first transistor and the second transistor in the input stage of the level shifter circuit of the invention are smaller than the W/L ratios of the first transistor and the second transistor in the prior art, the layout area of the level shifter circuit can be effectively decreased about 17% to reduce the costs of the level shifter circuit.

Above all, the level shifter circuit of the invention can be applied in the driving circuit of the LCD apparatus and it can effectively reduce the manufacturing costs and enhance the entire performance. Therefore, it is obvious that the level shifter circuit of the invention is better than the level shifter circuit of the prior arts.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A preferred embodiment of the invention is a level shifter circuit. In this embodiment, the level shifter circuit is applied in a driving IC (e.g., a source driver IC or a gate driver IC) of a display to convert an input signal having a lower voltage level into an output signal having a higher voltage level, but not limited to this.

Figure 1:
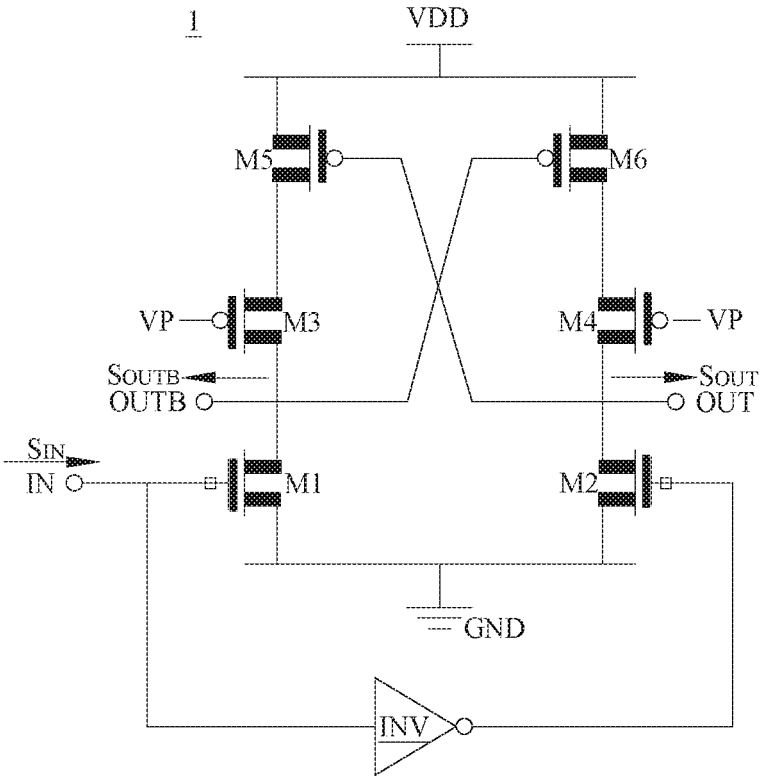
FIG. 1 (PRIOR ART)
FIG. 1 illustrates a schematic diagram of a common level shifter circuit in the prior art.
Figure 2:
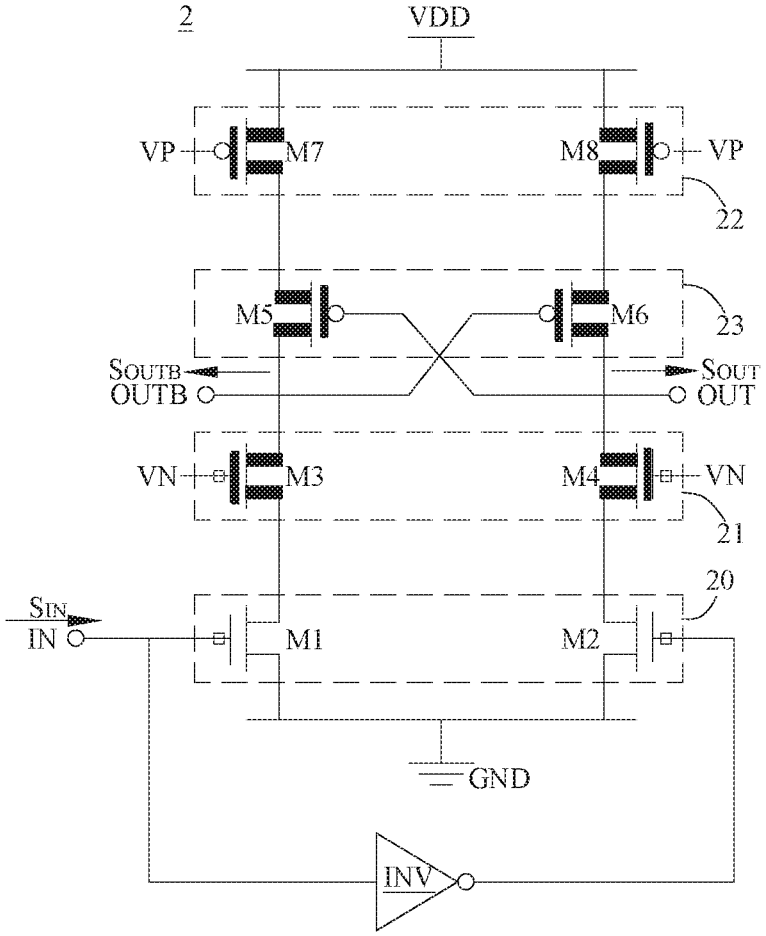
FIG. 2 illustrates a schematic diagram of the level shifter circuit in a preferred embodiment of the invention.

Please refer to FIG. 2. FIG. 2 illustrates a schematic diagram of the level shifter circuit in a preferred embodiment of the invention. In this embodiment, the level shifter circuit 2 is used to convert an input signal $S_{IN}$ having a first voltage into an output signals $S_{OUT}$ and $S_{OUTB}$ having a second voltage, wherein the second voltage is higher than the first voltage. Therefore, the output signal having the higher voltage can meet the requirement of the operation of the LCD apparatus.

As shown in FIG. 2, the level shifter circuit 2 includes an input terminal IN, a first output terminal OUT, a second output terminal OUTB, an inverter INV, an input stage 20, a first control bias unit 21, a second control bias unit 22 and an output stage 23. Wherein, the input stage 20, the first control bias unit 21, the second control bias unit 22 and the output stage 23 are coupled in series between an operating voltage VDD and a ground voltage GND.

In this embodiment, the input stage 20 includes a first transistor M1 and a second transistor M2; the first control bias unit 21 includes a third transistor M3 and a fourth transistor M4; the second control bias unit 22 includes a seventh transistor M7 and an eighth transistor M8; the output stage 23 includes a fifth transistor M5 and a sixth transistor M6.

The first transistor M1, the third transistor M3, the fifth transistor M5 and the seventh transistor M7 are coupled in series between the operating voltage VDD and the ground voltage GND; the second transistor M2, the fourth transistor M4, the sixth transistor M6 and the eighth transistor M8 are coupled in series between the operating voltage VDD and the ground voltage GND.

In practical applications, the first transistor M1, the second transistor M2, the third transistor M3 and the fourth transistor M4 can be N-type transistors and the fifth transistor M5, the sixth transistor M6, the seventh transistor M7 and the eighth transistor M8 can be P-type transistors, but not limited to this. An input terminal of the inverter INV is coupled between the input terminal IN and a gate of the first transistor M1; an output terminal of the inverter INV is coupled to a gate of the second transistor M2.

It should be noticed that the first transistor M1 and the second transistor M2 in the input stage 20 have lower threshold voltage values relatively; the third transistor M3, the fourth transistor M4, the fifth transistor M5, the sixth transistor M6, the seventh transistor M7 and the eighth transistor M8 have higher threshold voltage values relatively. That is to say, the threshold voltages of the first transistor M1 and the second transistor M2 in the input stage 20 will be smaller than the threshold voltages of the other transistors (e.g., the third transistor M3, the fourth transistor M4, the fifth transistor M5, the sixth transistor M6, the seventh transistor M7 and the eighth transistor M8) in the level shifter circuit 2, but not limited to this.

Therefore, even the input signal $S_{IN}$ received by the gates of the first transistor M1 and the second transistor M2 in the input stage 20 has very low voltage, the first transistor M1 and the second transistor M2 having very low threshold voltages can be still switched on smoothly, so that the level shifter circuit 2 of the invention can be normally operated to solve the problems occurred in the prior art.

In addition, since the threshold voltages of the first transistor M1 and the second transistor M2 in the input stage 20 are smaller than the threshold voltages of the other transistors (e.g., the third transistor M3, the fourth transistor M4, the fifth transistor M5, the sixth transistor M6, the seventh transistor M7 and the eighth transistor M8) in the level shifter circuit 2; therefore, the W/L ratios of the first transistor M1 and the second transistor M2 in the input stage 20 can be smaller than the W/L ratios of the other transistors (e.g., the third transistor M3, the fourth transistor M4, the fifth transistor M5, the sixth transistor M6, the seventh transistor M7 and the eighth transistor M8) in the level shifter circuit 2, but not limited to this.

The gate of the first transistor M1 in the input stage 20 is directly coupled to the input terminal IN; the gate of the second transistor M2 in the input stage 20 is coupled to the input terminal IN through the inverter INV. When the input signal $S_{IN}$ having very low voltage is inputted to the input terminal IN, the gate of the first transistor M1 will receive the input signal $S_{IN}$ having very low voltage. Since the first transistor M1 has very low threshold voltage, the first transistor M1 can be still switched on smoothly.

The gate of the second transistor M2 in the input stage 20 will receive a reverse-phase signal of the input signal $S_{IN}$ generated by the phase reversing process of the inverter INV. Although the reverse-phase signal of the input signal $S_{IN}$ also has very low voltage, the second transistor M2 having very low threshold voltage can be still switched on smoothly.

The third transistor M3 and the fourth transistor M4 of the first control bias unit 21 are coupled to the first transistor M1 and the second transistor M2 respectively, and gates of the third transistor M3 and the fourth transistor M4 are controlled by a first bias VN. It should be noticed that even the first transistor M1 and the second transistor M2 of the input stage 20 are low-voltage elements, if the first bias VN which is decoupling and easily controlled is properly selected, the first transistor M1 and the second transistor M2 of the input stage 20 will not burned out.

The fifth transistor M5 and the sixth transistor M6 in the output stage 23 are coupled to the third transistor M3 and the fourth transistor M4 respectively, and gates of the fifth transistor M5 and the sixth transistor M6 are coupled to the first output terminal OUT and the second output terminal OUTB of the level shifter circuit 2 respectively. Then, the first output terminal OUT and the second output terminal OUTB of the level shifter circuit 2 will output a first output signal $S_{OUT}$ and a second output signal $S_{OUTB}$ respectively.

In practical applications, since the level shifter circuit 2 can be applied in the driving IC of the display, the first output terminal OUT and the second output terminal OUTB of the level shifter circuit 2 can be coupled between a plurality of high-voltage elements in the driving IC. For example, the first output terminal OUT and the second output terminal OUTB of the level shifter circuit 2 can be coupled between output buffers or digital-to-analog converter (DACs) in the driving IC, but not limited to this.

The seventh transistor M7 and the eighth transistor M8 are coupled to the fifth transistor M5 and the sixth transistor M6 respectively, and gates of the seventh transistor M7 and the eighth transistor M8 are controlled by a second bias VP. In fact, the power consumption of the level shifter circuit 2 will be controlled by the second bias VP, but not limited to this.

Figures 3A, 3B, 3C:
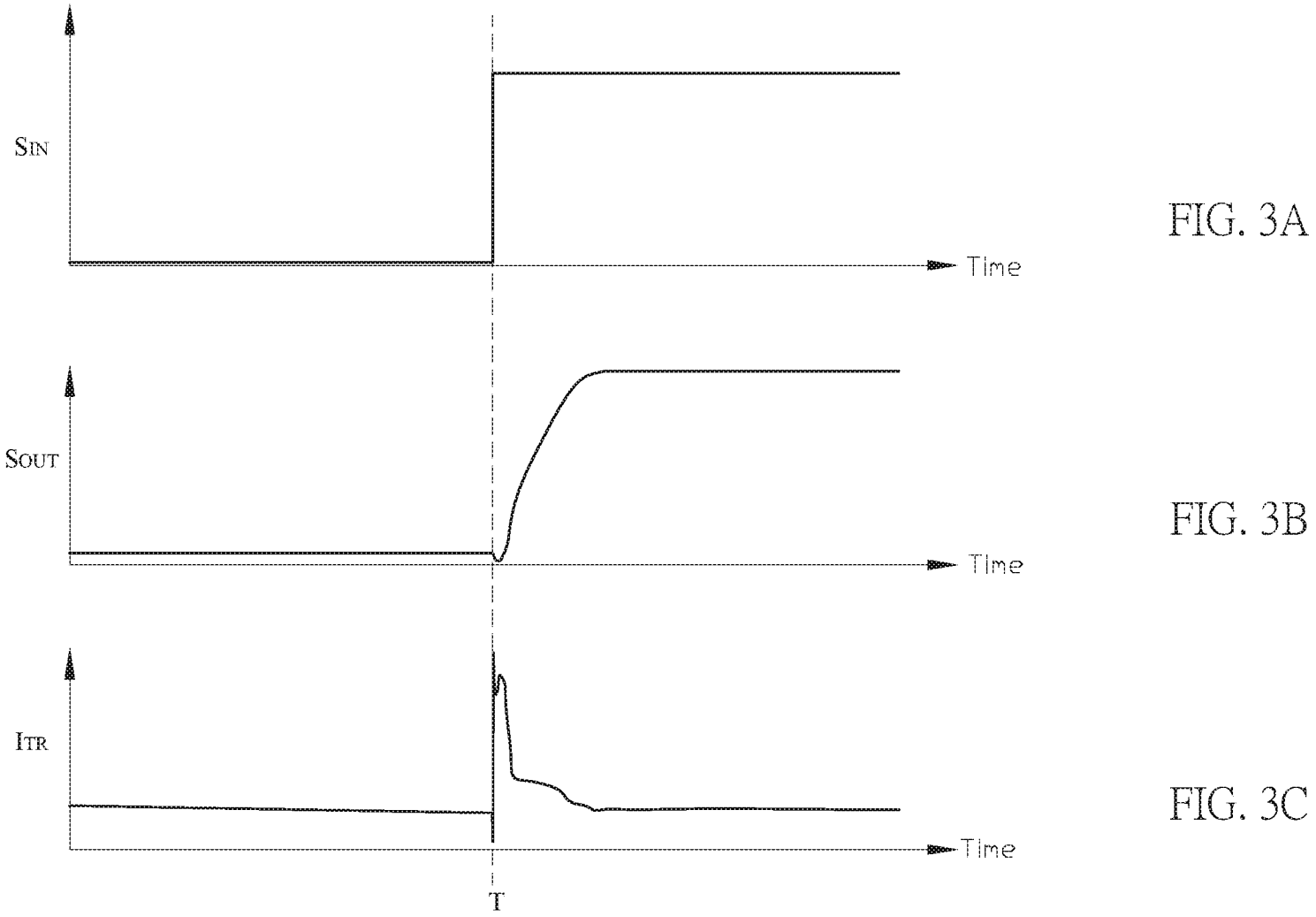
FIG. 3A~FIG. 3C illustrate waveform diagrams of the input signal, the output signal and the transient current respectively.

Then, please refer to FIG. 3A~FIG. 3C. FIG. 3A~FIG. 3C illustrate waveform diagrams of the input signal, the output signal and the transient current respectively. As shown in FIG. 3A, at a time T, the voltage level of the input signal $S_{IN}$ is changed from a low level to a high level.

As shown in FIG. 3B, at the time T, the output signals $S_{OUT}$ will be also changed from a low level to a high level. However, the increasing slope of the output signals $S_{OUT}$ is smaller than that of the input signal $S_{IN}$; in other words, the slew rate of the output signals $S_{OUT}$ is smaller than that of the input signal $S_{IN}$.

Furthermore, as shown in FIG. 3C, since the first transistor M1 and the second transistor M2 of the input stage 20 have smaller W/L ratios, when the input signal $S_{IN}$ is changed from the low level to the high level at the time T, a transient current $I_{TR}$ will be inhibited in certain degree without any instant surges.

Compared to the prior art, the level shifter circuit of the invention is applied in a source driving IC or a gate driving IC of a display; the level shifter circuit of the invention includes two bias controlling units and control power consumption through a second control bias. Since the first transistor and the second transistor in the input stage of the level shifter circuit of the invention are both low-voltage transistors having low threshold voltages, the W/L ratios of them can be small. Since the transistors have small W/L ratios in the input stage of the level shifter circuit and a proper second control bias is provided, the transient current can be reduced when the voltage level of the input signal is changed. Even the input signal inputted to the level shifter circuit of the invention has very low voltage, the first transistor and the second transistor having low threshold voltages in the input stage can be still switched on; therefore, the level shifter circuit of the invention can be normally operated.

In addition, since the W/L ratios of the first transistor and the second transistor in the input stage of the level shifter circuit of the invention are smaller than the W/L ratios of the first transistor and the second transistor in the prior art, the layout area of the level shifter circuit can be effectively decreased about 17% to reduce the costs of the level shifter circuit.

Above all, the level shifter circuit of the invention can be applied in the driving circuit of the LCD apparatus and it can effectively reduce the manufacturing costs and enhance the entire performance. Therefore, it is obvious that the level shifter circuit of the invention is better than the level shifter circuit of the prior arts.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A level shifter circuit composed of eight transistors comprising a first transistor, a second transistor, a third transistor, a fourth transistor, a fifth transistor, a sixth transistor, a seventh transistor and an eighth transistor, applied in a driving circuit of a display and converting an input signal having a first voltage into an output signal having a second voltage larger than the first voltage, the level shifter circuit comprising:

an input terminal configured to receive the input signal;

a first output terminal and a second output terminal configured to output the output signal respectively;

an input stage comprising the first transistor and the second transistor, wherein gates of the first transistor and the second transistor are coupled to the input terminal;

a first control bias unit comprising the third transistor and the fourth transistor coupled to the first transistor and the second transistor respectively, wherein gates of the third transistor and the fourth transistor are controlled by a first bias;

an output stage comprising the fifth transistor and the sixth transistor coupled to the third transistor and the fourth transistor respectively, wherein gates of the fifth transistor and the sixth transistor are coupled to the first output terminal and the second output terminal respectively; and a second control bias unit comprising the seventh transistor and the eighth transistor coupled to the fifth transistor and the sixth transistor respectively, wherein gates of the seventh transistor and the eighth transistor are controlled by a second bias, and power consumption of the level shifter circuit is controlled by the second bias;

wherein the first transistor, the second transistor, the third transistor and the fourth transistor are N-type transistors and the fifth transistor, the sixth transistor, the seventh transistor and the eighth transistor are P-type transistors; absolute values of threshold voltages of the first transistor and the second transistor of the input stage are smaller than absolute values of threshold voltages of the third transistor, the fourth transistor, the fifth transistor, the sixth transistor, the seventh transistor and the eighth transistor; the first transistor, the third transistor, the fifth transistor and the seventh transistor are coupled in series between an operating voltage and a ground voltage; the second transistor, the fourth transistor, the sixth transistor and the eighth transistor are also coupled in series between the operating voltage and the ground voltage; the first transistor and the second transistor in the input stage are both low-voltage transistors having low threshold voltages and small width/length (W/L) ratios and the second control bias is provided to reduce a transient current generated when a voltage level of the input signal is changed.

2. The level shifter circuit of claim 1, wherein the first output terminal and the second output terminal are coupled between a plurality of high-voltage elements in the driving circuit of the display.

3. The level shifter circuit of claim 2, wherein the plurality of high-voltage elements comprises an output buffer or a digital-to-analog converter (DAC).

4. The level shifter circuit of claim 1, wherein the gates of the first transistor and the second transistor receive the input signal and a reverse-phase signal of the input signal respectively and switched on accordingly.

5. The level shifter circuit of claim 1, wherein the driving circuit of the display is a source driver circuit or a gate driver circuit.

* * * * *